US006956554B2

(12) United States Patent
Chen et al.

(10) Patent No.: US 6,956,554 B2
(45) Date of Patent: Oct. 18, 2005

(54) APPARATUS FOR SWITCHING OUTPUT VOLTAGE SIGNALS

(75) Inventors: Yen-Chen Chen, Tainan (TW); Chien-Pin Chen, Yungkang (TW); Chuan-Cheng Hsiao, Chiai (TW); Lin-Kai Bu, Tainan (TW); Kun-Cheng Hung, Hsinchu (TW)

(73) Assignee: Chi Mei Optoelectronics Corp., (TW)

( * ) Notice: Subject to any disclaimer, the term of this patent is extended or adjusted under 35 U.S.C. 154(b) by 262 days.

(21) Appl. No.: 10/212,077

(22) Filed: Aug. 6, 2002

(65) Prior Publication Data

US 2003/0030631 A1 Feb. 13, 2003

(30) Foreign Application Priority Data

Aug. 8, 2001 (TW) ..... 90119362 A

(51) Int. Cl.[7] ..... G09G 3/36
(52) U.S. Cl. ..... 345/98; 345/99
(58) Field of Search ..... 345/50–52, 55, 345/87, 98–100, 211, 94, 212

(56) References Cited

U.S. PATENT DOCUMENTS

| | | | | |
|---|---|---|---|---|
| 6,335,716 | B1 * | 1/2002 | Yamazaki et al. | 345/92 |
| 6,744,415 | B2 * | 6/2004 | Waterman et al. | 345/87 |
| 2002/0063674 | A1 * | 5/2002 | Chiang | 345/98 |
| 2002/0145600 | A1 * | 10/2002 | Morita | 345/211 |
| 2002/0158862 | A1 * | 10/2002 | Chen et al. | 345/211 |

* cited by examiner

*Primary Examiner*—Kent Chang
(74) *Attorney, Agent, or Firm*—Rabin & Berdo, P.C.

(57) ABSTRACT

An apparatus for switching output voltage signals includes a resistor string, a first switching device set for delivering a number of gamma voltage input signals, a second switching device set for delivering a high voltage input signal and a low voltage input signal, and a switch selecting device coupled to the first switching device set and the second switching device set. When the switch selecting device outputs a first signal, the first switching device set can deliver the gamma voltage input signals to the resistor string; when the switch selecting device outputs a second signal, the second switching device set will deliver the high voltage input signal and the low voltage input signal to the resistor string.

16 Claims, 5 Drawing Sheets

APPARATUS FOR SWITCHING OUTPUT VOLTAGE SIGNALS

BACKGROUND OF THE INVENTION

This application incorporates by reference of Taiwan application Serial No. 90119362, filed on Aug. 8, 2001.

1. Field of the Invention

The invention relates in general to the voltage signal outputting apparatus, and more particularly to the apparatus for switching output voltage signals.

2. Description of the Related Art

Benefited from the advantages of the thinness, lightness and low radiation properties, LCDs (Liquid Crystal Display) have been widely used in the world.

FIG. 1 shows the block diagram of a conventional driver of a liquid crystal display. The color liquid crystal display panel 100 includes 1280×1024 displaying units. Each displaying unit includes three pixels for displaying red, green and blue respectively. Each pixel is controlled by a corresponding scan line and a corresponding data line. Thus, the whole panel includes 1024 scan lines and 1280×3=3840 data lines. When the panel displays a frame, a scan driver 104 can output a scan signal to enable each scan line in turn according to a first control signal (CTRL1). At the same time, a data driver 106 outputs analog pixel data signals (DATA) to the corresponding pixels respectively according to corresponding digital pixel data signals (DT), a second control signal (CTRL2) and gamma voltage input signals (GMV). The data driver 106 includes a nonlinear digital-to-analog converter (D/A converter) 108 for converting each digital pixel data signal (DT) to the corresponding analog pixel data signal (DATA) according to the gamma voltage input signals (GMV). The analog pixel data signal (DATA) is outputted to the corresponding pixel through the corresponding data line. The magnitude of the analog pixel data signal (DATA) determines the luminance (represented by gray level scales) of the pixel.

FIG. 2 shows the relationship between the gamma voltage of the liquid crystal display and the light transmittance of the pixel. The X-axis is indicative of the voltage of the lower plate and the Y-axis represents the light transmittance of the pixel. When upper plate voltage is Vcom, the lower plate voltage is called the gamma voltage. The electric potential difference between the gamma voltage and Vcom determines the light transmittance of the pixel. The relationship between the gamma voltage and the light transmittance of the pixel is not linear, but is like the gamma curve showed in FIG. 2 instead. Therefore, the lower plate voltage is called the gamma voltage. The magnitude of the gamma voltage influences the light transmittance of the pixel, but the polarity of the gamma voltage does not influence the light transmittance of the pixel. For example, when the gamma voltage changes from Va to Vb, the light transmittance of the pixel will not change, which is shown in FIG. 2. The nonlinear digital-to-analog converter 108 of the data driver 106 converts the digital pixel data signals (DT) to corresponding analog pixel data signals (DATA) according to the gamma relation between the gamma voltage and the light transmittance pf the pixel. The above-mentioned procedure is called gamma correction. The X-axis is indicative of the voltage of the lower plate and the Y-axis represents the light transmittance of the pixel.

FIG. 3 shows the gamma curve, which is for use in the data driver to perform gamma correction. The X-axis shows the magnitude the digital pixel data signals (DT) which are represented by binary numbers of six bits and the Y-axis shows the corresponding gamma voltages signals to the digital pixel data signals (DT). The gamma curve shown in FIG. 3 includes a positive polarity gamma curve 302 and a negative polarity gamma curve 304. Each digital pixel data signal (DT) corresponds to a positive polarity gamma voltage signal and a negative polarity gamma voltage signal. The points A, B, C, D and E chosen from the positive polarity gamma curve 302 and the points A', B', C', D' and E' chosen from the negative polarity gamma curve 304 are reference points when performing gamma correction. According to the gamma curve shown in FIG. 3, each of the reference points corresponds to a gamma voltage input signal (GMV) and a digital pixel data signal (DT). The corresponding gamma voltage input signals (GMV) are reference gamma voltages while the corresponding digital pixel data signals (DT) are reference pixel data signals. When performing gamma correction, the nonlinear digital-to-analog converter 108 is to use the inner interpolation method to convert the digital pixel data signal (DT) to the gamma output voltage signal (DATA) according to those reference gamma voltages (GMV) and the reference pixel data signals (DT).

FIG. 4 shows a conventional apparatus for outputting the gamma voltage output signals. The conventional apparatus for outputting gamma voltage output signals is a string of resistors which is composed of a number of resistors (R0~R31). The resistor string shown in FIG. 4 includes four input nodes for receiving the gamma voltage input signals (GMV) and thirty-four output nodes for outputting the gamma voltage output signals (DATA) respectively. When receiving the reference gamma voltages (V0~V9) from the corresponding input nodes of the resistor string, each output node of the resistor string can output the corresponding gamma voltage output signal (DATA).

FIG. 5 shows the diagram of the driving circuit of the pixel P(N, M). The driving circuit of the pixel P(N, M) includes a thin film transistor T(N, M) and a pixel capacitor C(N, M). The gate electrode of the transistor T(N, M) is coupled to the scan line (SN) $S_N$, the source electrode of the transistor T(N, M) is coupled to the data line (DN) $D_M$, and the drain electrode of the transistor T(N, M) is coupled to the pixel capacitor C(N, M). When the scan driver enables the scan line (SN) $S_N$, the transistor T(N, M) can be turned ON. At the same time, the analog pixel data signal (DATA) is delivered to the pixel capacitor C(N, M) through the data line (DN) $D_M$ and the transistor T(N, M). The luminance of the pixel P(N, M) is controlled by the voltage of the pixel capacitor C(N, M).

The gamma voltage output signal (DATA) inputted to the capacitor of each pixel has to be refreshed after every short period of waiting time. The period of the waiting time is defined to be the refresh rate of the display panel. If the refresh rate of the display panel is too slow, the magnitude of the pixel capacitor voltage will change due to the leaky current of the pixel. Therefore, the displaying color of the panel will change and the displaying frame will flicker. If the refresh rate of the display panel is too fast, the magnitude of power consumption of the driving circuit of the liquid crystal display will be enormous. To sum up, the disadvantage of the conventional gamma correction apparatus is unable to maintain the displaying performance of the panel and to reduce the total power consumption of the driving circuit at the same time.

SUMMARY OF THE INVENTION

It is therefore an object of the invention to provide an apparatus for switching output voltage signals to reduce the total power consumption of the driving circuit of liquid crystal display without influencing the displaying performance of the panel.

The invention achieves the above-identified objects by providing an apparatus for switching output voltage signals to output signals in either case, one is outputting a number of gamma voltage output signals, the other is outputting a high voltage signal and a low voltage signal. The output voltage signals switching apparatus includes a resistor string, a first switching device set, a second switching device set, and a switch selecting device. The first switching device set is for delivering a number of gamma voltage input signals, wherein the first switching device set includes a number of voltage signal input nodes for receiving the gamma voltage input signals. The second switching device set is for delivering a high voltage input signal and a low voltage input signal, wherein the second switching device set includes a high voltage signal input node for receiving the high voltage input signal and a low voltage signal input node for receiving the low voltage input signal. The resistor string coupled to the first switching device set and the second switching device set is for outputting the gamma voltage output signals according to the gamma voltage input signals, or outputting the high voltage output signal and the low voltage output signal according to the high voltage input signal and the low voltage input signal respectively, wherein the resistor string includes a number of signal input nodes for receiving the gamma voltage input signals, the high voltage signal, and the low voltage signal. The switch selecting device is coupled to the first switching device set and the second switching device set. When the switch selecting device outputs a first signal, the first switching device set will deliver the gamma voltage input signals to the resistor string. When the switch selecting device outputs a second signal, the second switching device set will deliver the high voltage input signal and the low voltage input signal to the resistor string.

Other objects, features, and advantages of the invention will become apparent from the following detailed description of the preferred but non-limiting embodiments. The description is made with reference to the accompanying drawings.

DESCRIPTION OF THE PREFERRED EMBODIMENT

The present invention provides an apparatus for switching output voltage signals. When the liquid crystal display operates in a normal mode, the output voltage signals switching apparatus will output a number of gamma voltage output signals. When the liquid crystal display operates in an idle mode or a power saving mode, the output voltage signals switching apparatus will output a high voltage output signal and a low voltage output signal.

Figure 6:
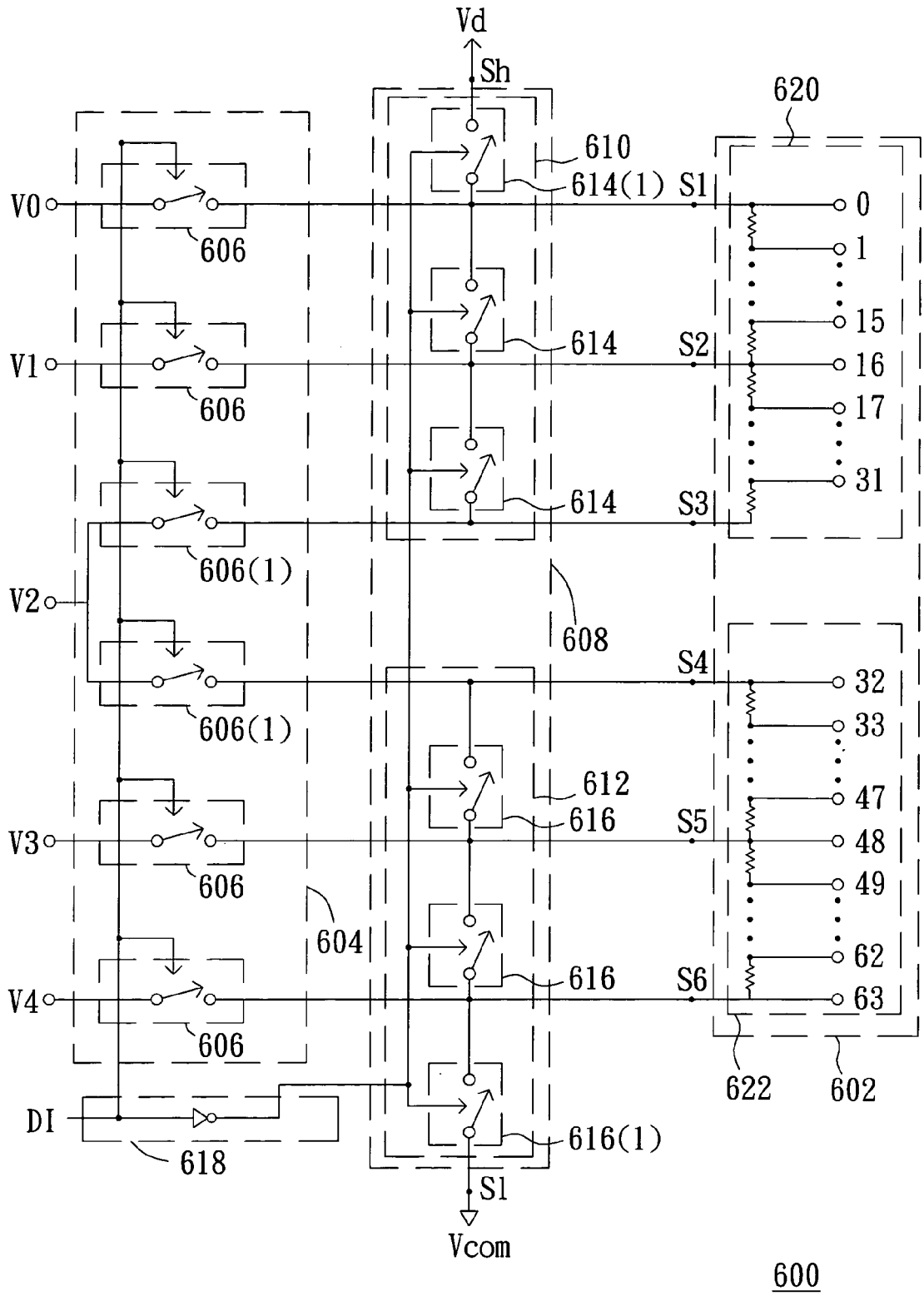
FIG. 6 shows the diagram of the apparatus for switching output voltage signals according to the preferred embodiment of the invention.

FIG. 6 shows the diagram of the apparatus for switching output voltage signals according to the preferred embodiment of the invention. The output voltage signals switching apparatus 600 outputs signals in either case, one is outputting a number of gamma voltage output signals, the other is outputting a high voltage output signal and a low voltage output signal. The apparatus includes a first switching device set 604, a second switching device set 608, a resistor string 602 coupled to the first switching device set and the second switching device set, and a switch selecting device 618 coupled to the first switching device set and the second switching device set.

The first switching device set 604 includes six first switching devices 606. Each of the first switching devices 606 includes a voltage signal input node for receiving the corresponding gamma voltage input signal (V0~V4). In this embodiment, two of the first switching devices 606(1) receive the same gamma voltage input signal (V2). Each of the first switching devices 606 is coupled to the corresponding signal input node (S1~S6) of the resistor string 602 respectively for delivering the gamma voltage input signal (V0~V4) to the resistor string 602.

The second switching device set 608 includes a high voltage signal switching device set 610 and a low voltage signal switching device set 612. The high voltage signal switching device set 610 further includes three high voltage signal switching devices 614 and the low voltage signal switching device set 612 further includes three low voltage signal switching devices 616. One of the high voltage signal switching device 614(1) is coupled to the high voltage signal input node (Sh) for receiving the high voltage input signal (Vd) and One of the low voltage signal switching devices 616(1) is coupled to the low voltage signal input node (Sl) for receiving the low voltage input signal (Vcom).

The resistor string 602 shown in FIG. 6 includes sixty-three series resistors. The resistor string 602 includes six signal input nodes (S1-S6) for receiving the gamma voltage input signals, the high voltage signal and the low voltage signal. Each signal input node of the resistor string 602 is coupled to the first switching device set 604 and the second switching device set 608 respectively. The resistor string 602 further includes sixty-four signal output nodes (node 0~node 63) for outputting signals in either case, one is outputting the gamma voltage output signals according to the gamma voltage input signals (V0~V4), the other is outputting the high voltage output signal according to the high voltage input signal (Vd), and the low voltage output signal according to the low voltage input signal (Vcom) respectively.

In this embodiment, the resistor string is divided into a high voltage signal resistor string 620 and a low voltage signal resistor string 622. The signal input nodes (S1~S3) of the high voltage signal resistor string 620 are coupled to the corresponding high voltage signal switching devices 614 respectively and the signal input nodes (S4~S6) of the low voltage signal resistor string 622 are coupled to the corresponding low voltage signal switching devices 616 respectively.

The switch selecting device 618 is coupled to each of the first switching device 606, the high voltage signal switching device 614, and the low voltage signal switching device 616.

When the liquid crystal display operates in a normal mode, the switch selecting device 618 will output a first signal. When receiving the first signal, each of the first switching devices 606 will be turned ON. At the same time, each of the high voltage signal switching devices 614 and each of the low voltage signal switching devices 616 will be turned OFF. The gamma voltage input signal (V0~V4) will be delivered by the corresponding first switching devices 606 to the resistor string 602 respectively. When receiving the gamma voltage input signals (V0~V4), the resistor string 602 can output sixty-four different gamma voltage output signals from sixty-four signal output nodes (0~63) respectively. The magnitude of the gamma voltage output signals outputted from node0, node1, . . . , and node63 are a sequence of amplitudes in decreasing order.

If a user has not given any command to the liquid crystal display for a period of waiting time, or the power stored in the battery of the liquid crystal display has been run out, the liquid crystal display would operate in an idle mode or a power saving mode to reduce the total power consumption of the liquid crystal display. It is assumed that the user is not using the liquid crystal display when the user has not given any command to the liquid crystal display for a period of predetermined waiting time. Therefore, the displaying performance of the panel is not the most important issue. To reduce the total power consumption will be more important than the displaying performance of the panel under that situation.

When liquid crystal display operates in the power saving mode, the switch selecting device 618 of the output voltage signal switching apparatus 600 can output a second signal. When receiving the first signal, each of the first switching devices 606 can be turned OFF. At the same time, each of the high voltage signal switching devices 614 and the low voltage signal switching devices 616 can be turned ON. All of the high voltage signal switching devices 614 are coupled to the high voltage signal input node (Sh) to receive the high voltage signal (Vd) and deliver it to the signal input node (S1~S3) of the high voltage signal resistor string 620. All of the low voltage signal switching devices 616 are coupled to the low voltage signal input node (Sl) to receive the low voltage signal (Vcom) and deliver it to the signal input node (S4~S6) of the low voltage signal resistor string 622. Thus, the signal output node 0~node 31 of the resistor string 602 can output the same high voltage signal (Vd) and the signal output node 32~node 63 of the resistor string 602 can output the same low voltage signal (Vcom).

When the nonlinear digital-to-analog converter uses the high voltage signal (Vd) and the low voltage signal (Vcom) as the reference gamma voltage signal to perform gamma correction, the outputting analog pixel data signal is either the high voltage signal (Vd) or the low voltage signal (Vcom). When the high voltage signal (Vd) is provided, the pixel will display in the maximum luminance; when the low voltage signal (Vcom) is provided, the pixel will display in the minimum luminance. Therefore, when the liquid crystal display operates in the power saving mode, the pixels will display either in the maximum luminance or in the minimum luminance.

To reduce the total power consumption is more important than the displaying performance of the panel when the liquid crystal display operates in the power saving mode. The pixels are either in the maximum luminance or in the minimum luminance in the power saving mode. The change of the magnitude of the pixel capacitor voltages due to the leaky currents of the pixels do not have obvious effect upon the color performance of the panel. Therefore, the refresh rate of the panel in the present invention can be much slower compared to the conventional apparatus. The total power consumption of the driver circuit of the liquid crystal display can be reduced.

Figure 1:
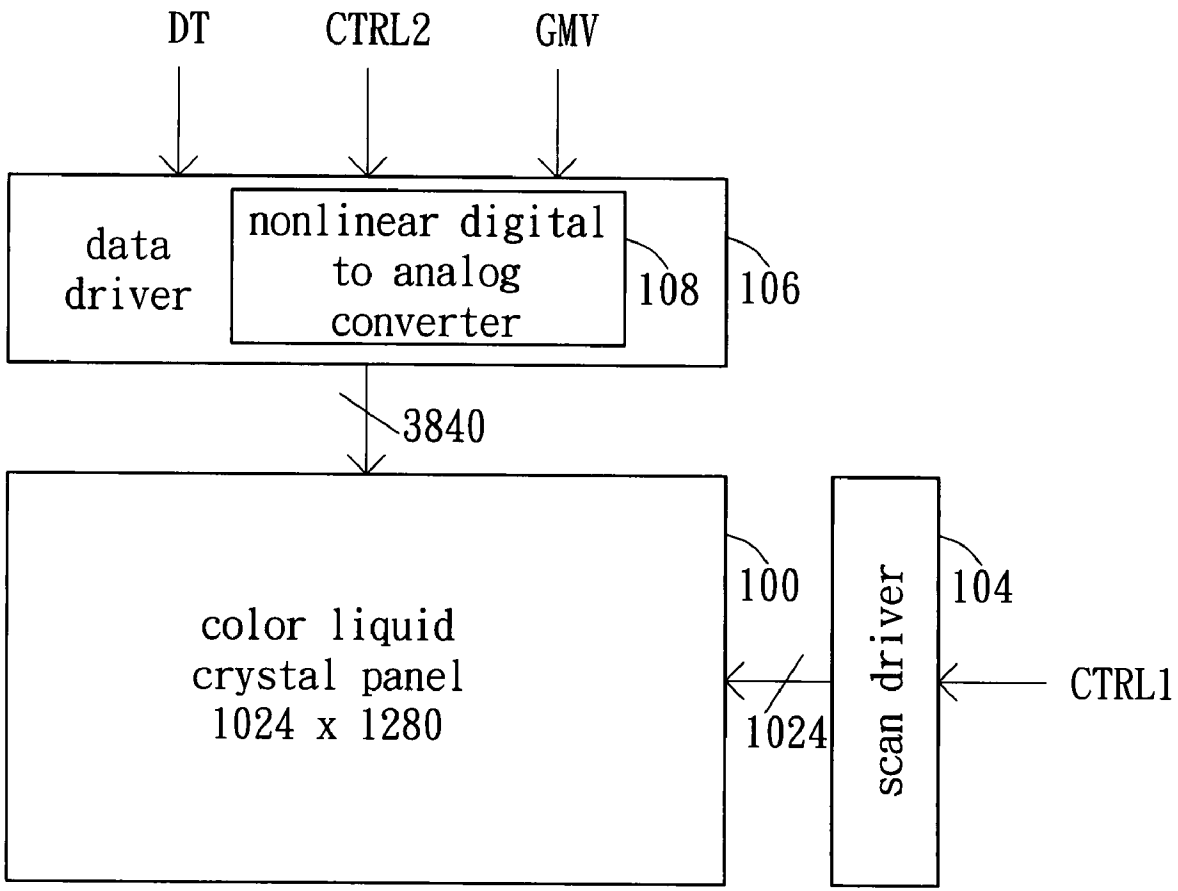
FIG. 1 (PRIOR ART)
FIG. 1 (Prior Art) shows the diagram of the liquid crystal display and the driver thereof.
Figure 2:
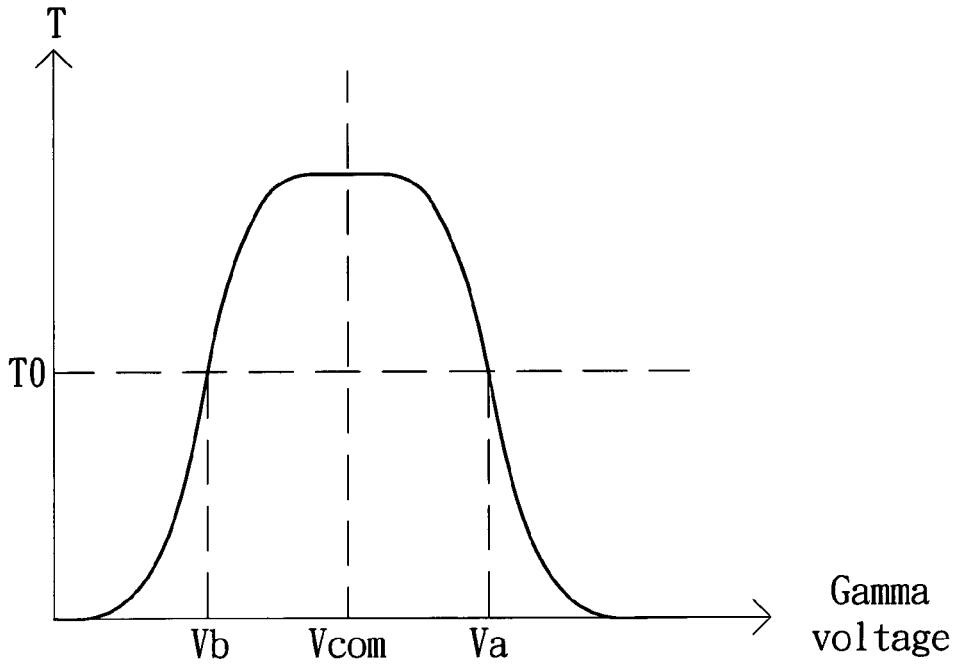
FIG. 2 (PRIOR ART)
FIG. 2 (Prior Art) shows the relationship between the gamma voltage and the light transmittance of the pixel.
Figure 3:
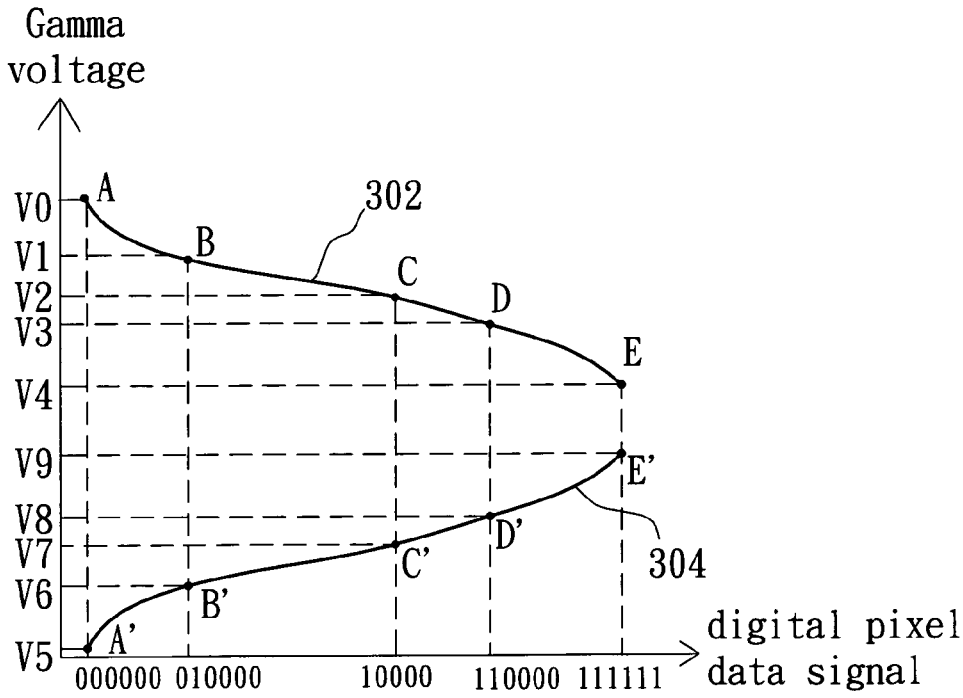
FIG. 3 (PRIOR ART)
FIG. 3 (Prior Art) shows the gamma curve which is for use in the data driver to perform gamma correction.
Figure 4:
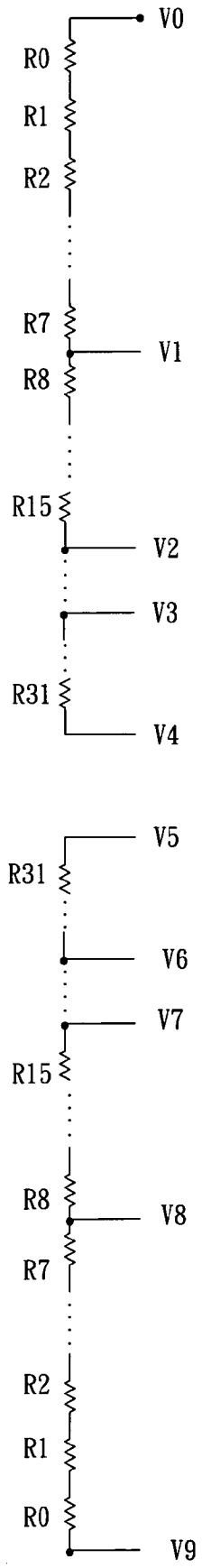
FIG. 4 (PRIOR ART)
FIG. 4 (Prior Art) shows the diagram of the conventional apparatus for outputting the gamma voltage output signals.
Figure 5:
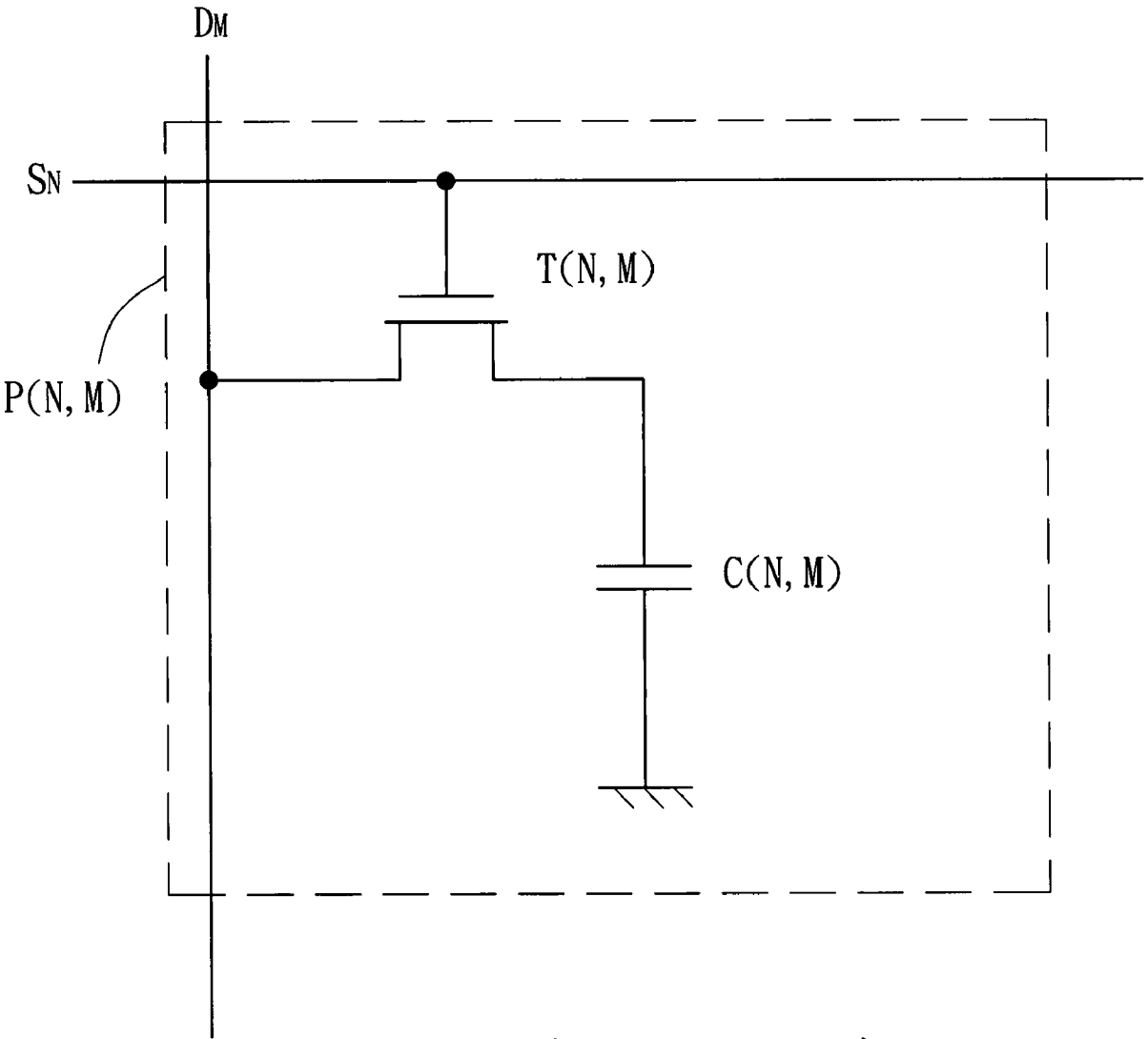
FIG. 5 (PRIOR ART)
FIG. 5 (Prior Art) shows the diagram of the driving circuit of the pixel P(N, M)

The output voltage switching apparatus 600 as shown in FIG. 6 outputs the positive polarity gamma voltage signals only. It must operate in coordination with another output voltage switching apparatus which is for outputting the negative polarity gamma voltage signals. The difference between the output voltage switching apparatus for outputting the positive polarity gamma voltage signals and for outputting the negative polarity gamma voltage signals is that the magnitude of the high voltage signal is Vcom and the low voltage signal is 0 in the output voltage switching apparatus which is for outputting the negative polarity gamma voltage signals. Besides, the gamma voltage input signals receiving by the first switching device set 604 must be changed from V0~V4 to V9~V5 respectively according to FIG. 3.

The output voltage switching apparatus of the present invention is for use in the data driver of the liquid crystal display. The magnitude of the output voltage signals outputted from the output voltage switching apparatus can be controlled by the data driver directly.

The apparatus for switching the output voltage signal in accordance with the invention has the following advantages. First, the magnitude of the output voltage signals can be changed according to the operating mode of the liquid crystal display. When the liquid crystal display operates in a normal mode, the output voltage signals switching apparatus can output a number of gamma voltage signals. When the liquid crystal display operates in an idle mode or a power saving mode, the output voltage signals switching apparatus can output just a high voltage signal and a low voltage signal. Second, when the liquid crystal display operates in a power saving mode, the refresh rate of the display panel can be slower compared to the conventional apparatus without obviously influencing the color performance of the panel, and thus the total power consumption of the liquid crystal display can be reduced. Third, the output voltage switching apparatus is for use in the data driver of the liquid crystal display. The output voltage signals outputted from the output voltage switching apparatus can be controlled by the data driver directly.

While the invention has been described by way of example and in terms of the preferred embodiment, it is to be understood that the invention is not limited to the disclosed embodiment. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An apparatus for switching output voltage signals, applied to a liquid crystal display (LCD), for selectively outputting either a plurality of gamma voltage output signals or a high voltage output signal and a low voltage output signal, the apparatus comprising:

a first switching device set for delivering gamma voltage input signals, wherein the first switching device set includes a plurality of voltage signal input nodes for respectively receiving the gamma voltage input signals;

a second switching device set for delivering a high voltage input signal and a low voltage input signal, wherein the second switching device set includes a high voltage signal input node for receiving the high voltage input signal and a low voltage signal input node for receiving the low voltage input signal;

a resistor string having a plurality of resistors and coupled to the first switching device set and the second switching device set, for selectively outputting either the gamma voltage output signals according to the gamma voltage input signals or a high voltage output signal according to the high voltage input signal and a low voltage output signal according to the low voltage input signal; and a switch selecting device coupled to the first switching device set and the second switching device set, wherein when the switch selecting device outputs a first signal, the first switching device set will deliver the gamma voltage input signals to the resistor string, and when the switch selecting device outputs a second signal, the second switching device set will deliver the high voltage input signal and the low voltage input signal to the resistor string;

wherein the switch selecting device outputs a first signal when the liquid crystal display operates in a normal mode, and a second signal when the liquid crystal display operates in an idle mode or a power saving mode.

2. The apparatus according to claim 1, wherein the first switching device set comprises a plurality of first switching devices for delivering the gamma voltage input signals, and each of the first switching devices receives one of the gamma voltage input signals from one of the voltage signal input nodes.

3. The apparatus according to claim 2, wherein each of the first switching devices is coupled to at least one of the resistors.

4. The apparatus according to claim 2, wherein a switch selecting device is coupled to each of the first switching devices, wherein when the switch selecting device outputs the first signal, the first switching devices can deliver the gamma voltage input signals to the resistor string, and when the switch selecting device outputs the second signal, the first switching devices can not deliver the gamma voltage input signals to the resistor string.

5. The apparatus according to claim 1, wherein the second switching device set includes a plurality of high voltage signal switching devices for delivering the high voltage input signal and a plurality of low voltage signal switching devices for delivering the low voltage input signal.

6. The apparatus according to claim 5, wherein each of the high voltage signal switching devices is coupled to at least one of the resistors and each of the low voltage signal switching devices is coupled to at least one of the resistors.

7. The apparatus according to claim 5, wherein the switch selecting device is coupled to each of the high voltage signal switching devices and each of the low voltage signal switching devices, wherein when the switch selecting device outputs the second signal, all of the high voltage signal switching devices can deliver the high voltage input signal to the resistor string, and all of the low voltage signal switching devices can deliver the low voltage input signal to the resistor string, and when the switch selecting device outputs the first signal, all of the high voltage signal switching devices cannot deliver the high voltage input signal to the resistor string and all of the low voltage signal switching devices cannot deliver the low voltage input signal to the resistor string.

8. The apparatus according to claim 1, wherein the output voltage signal switching apparatus is applied to a data driver of the liquid crystal display.

9. An apparatus for switching output voltage signals, applied to the liquid crystal display (LCD), for selectively outputting either a plurality of gamma voltage output signals or a high voltage output signal and a low voltage output signal, the apparatus comprising:

a first switching device set for delivering the gamma voltage input signals when the liquid crystal display operates in a normal mode, wherein the first switching device set includes a plurality of voltage signal input nodes for respectively receiving the gamma voltage input signals;

a second switching device set for delivering a high voltage input signal and a low voltage input signal when the liquid crystal display operates in an idle mode or a power saving mode, wherein the second switching device set includes a high voltage signal input node for receiving the high voltage input signal and a low voltage signal input node for receiving the low voltage input signal;

a resistor string having a plurality of resistors and coupled to the first switching device set and the second switching device set, for selectively outputting either the gamma voltage output signals according to the gamma voltage input signals or a high voltage output signal according to the high voltage input signal and a low voltage output signal according to the low voltage input signal; and a switch selecting device coupled to the first switching device set and the second switching device set, wherein when the switch selecting device outputs a first signal, the first switching device set will deliver the gamma voltage input signals to the resistor string, and when the switch selecting device outputs a second signal, the second switching device set will deliver the high voltage input signal and the low voltage input signal to the resistor string.

10. The apparatus according to claim 9, wherein the first switching device set comprises a plurality of first switching devices for delivering the gamma voltage input signals, and each of the first switching devices receives one of the gamma voltage input signals from one of the voltage signal input nodes.

11. The apparatus according to claim 10, wherein each of the first switching devices is coupled to at least one of the resistors.

12. The apparatus according to claim 10, wherein the switch selecting device is coupled to each of the first switching devices, wherein when the switch selecting device outputs the first signal, the first switching devices can deliver the gamma voltage input signals to the resistor string, and when the switch selecting device outputs the second signal, the first switching devices can not deliver the gamma voltage input signals to the resistor string.

13. The apparatus according to claim 9, wherein the second switching device set includes a plurality of high voltage signal switching devices for delivering the high voltage input signal and a plurality of low voltage signal switching devices for delivering the low voltage input signal.

14. The apparatus according to claim 13, wherein each of the high voltage signal switching devices is coupled to at least one of the resistors and each of the low voltage signal switching devices is coupled to at least one of the resistors.

15. The apparatus according to claim 13, wherein the switch selecting device is coupled to each of the high voltage signal switching devices and each of the low voltage signal switching devices, wherein when the switch selecting device outputs the second signal, all of the high voltage signal switching devices can deliver the high voltage input signal to the resistor string, and all of the low voltage signal switching devices can deliver the low voltage input signal to the resistor string, and when the switch selecting device outputs the first signal, all of the high voltage signal switching devices cannot deliver the high voltage input signal to the resistor string and all of the low voltage signal switching devices cannot deliver the low voltage input signal to the resistor string.

16. The apparatus according to claim 9, wherein the output voltage signal switching apparatus is applied to a data driver of the liquid crystal display.

* * * * *